US006302390B1

(12) United States Patent
Clark et al.

(10) Patent No.: US 6,302,390 B1
(45) Date of Patent: Oct. 16, 2001

(54) SHEET STACKING TRAY WITH STACKING GUIDES SYSTEM FOR A WIDE RANGE OF SHEET SIZES

(75) Inventors: Lawrence A. Clark, Webster, NY (US); D Gregory Yow, Wake Forest, NC (US); Michael J. Linder, Walworth, NY (US); Kenneth P. Moore, Rochester, NY (US); William R. Haag, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/467,615

(22) Filed: Dec. 20, 1999

(51) Int. Cl.[7] ..... B65H 1/00
(52) U.S. Cl. ..... 271/171
(58) Field of Search ..... 271/171

(56) References Cited

U.S. PATENT DOCUMENTS 5,029,841 * 7/1991 Ettischer et al. ..... 271/171
5,360,207 11/1994 Rauen et al. ..... 271/265
5,573,236 * 11/1996 Petocchi et al. ..... 271/171

FOREIGN PATENT DOCUMENTS

1419508 * 12/1975 (GB) ..... 271/171
0051424 * 3/1986 (JP) ..... 271/171
404358631A * 12/1992 (JP) ..... 271/171
405278869A * 10/1993 (JP) ..... 271/171

* cited by examiner

*Primary Examiner*—H. Grant Skaggs

(57) ABSTRACT

A sheet stacking tray system for stacking different sizes of copy sheets on a stack supporting tray to be fed upstream to a reproduction apparatus for printing, on which tray the stack is registered against a side registration edge. An upstanding stack rear edge guide is track mounted for movement at an angle to that side registration edge to provide a large repositioning movement in the upstream direction together with automatic lateral movement toward or away from that side registration edge, so as to engage the rear edge of a stack of larger sheets further from the registration edge, more centrally of the downstream edge of those sheets, and to engage smaller sheets closer to the registration edge and thus more towards their centers. Two independent upstanding stack side edge guides may be repositionable towards the registration edge independently of, and not overlapping, any position of the angulary moving rear edge guide. The rear edge guide may be linearly track mounted at approximately 18 degrees to the registration edge. All three stack edge guides may extend through and move along separate elongated apertures in the tray. The downstream edge guide may be repositionable substantially closer to the registration edge than the upstream side edge guide due to the angular track of the rear side guide.

4 Claims, 3 Drawing Sheets

SHEET STACKING TRAY WITH STACKING GUIDES SYSTEM FOR A WIDE RANGE OF SHEET SIZES

Cross-reference and incorporation by reference is made to the following copending and commonly assigned applications, especially as to details of suitable exemplary stack feeding and stack air fluffing systems for feeding copy sheets to a printer which can be incorporated with the disclosed embodiment of the present invention: U.S. application Ser. Nos. 09/220,972; 09/220,974; 09/220,975, now U.S. Pat. No. 6,186,492, issued Feb. 13, 2001; 09/220,976; 09/220,977, all filed Dec. 23,1998.

Disclosed in the embodiments herein is an improved, yet relatively simple and low cost, sheet stacking tray system with an improved system of resetable stack edge guides for accommodating and providing improved feeding of a large range of copy sheet sizes from stacks thereof in said sheet stacking tray.

By way of background in this crowded art, there are numerous different known types of stacking tray and sheet feeder systems and hardware for feeding copy sheets to xerographic printers or other reproduction systems. Such systems often have adjustable position stack edge guides and stack end guides to accommodate the stacking therein, and feeding therefrom, of a more limited range of different sizes of copy sheets. The following patent disclosures are noted merely by way of a few examples: U.S. Pat. Nos. 5,360,207; and also 5,188,351; 5,923,942; and 5,328,166. Likewise, the use of various sheet stack elevators is well known in such systems, and is not part of this specific invention, and thus need not be described herein. Such stack elevators are will known for vertically moving up a stacking tray to maintain the top of a large stack of copy sheets on said stacking tray in engagement with a sheet feeder as paper is sequentially fed from the top of the stack, as is well known in this art. They are typical of high capacity ("high-cap" stacking trays in which several reams of paper can be loaded at one time, as disclosed for example in Xerox Corp. U.S. Pat. Nos. 4,436,406; 4,718,658; 5,152,520; and 5,328,167.

The disclosed sheet stacking tray embodiment is particularly suited for improved stacking, locating, guiding and feeding of a uniquely wide range of different sizes of copy sheets by providing several advantages as will be described herein. In particular, as disclosed in the specific embodiment herein, the stack rear edge (trail edge) guide is repositionable along a predetermined angled path at a small preset angle to the sheet feeding direction, so that as the stack rear edge guide is repositioned forwardly for shorter size sheets stacked therein, that rear edge guide also automatically also moves laterally to move closer to the stack edge registration wall or guide(s). The initial lateral positions, and said variable positions along said angled path, of said rear edge guide are selected so that for many standard sheet sizes said rear edge guide will more centrally engage the rear edge of the stack for large sheets as well as much smaller size sheets stacked in the same sheet stacking tray. Furthermore, and cooperatively, said angular movement positions of said rear edge guide are designed to avoid interference or overlapping with the guide tracks or movement ranges of the transversely movable (repositionable) side guides engaging the opposite side of the stack from the stack edge registration wall.

A specific feature of the specific embodiment disclosed herein is to provide in a sheet stacking tray system for stacking different sizes of copy sheets to be fed upstream to a reproduction apparatus for the printing of said copy sheets, said stacking tray system having a stack supporting tray and plural upstanding stack edge guides for engaging at least two sides of a stack of copy sheets on said stack supporting tray, and wherein said plural stack edge guides are repositionable relative to said stack supporting tray for engaging at least two orthogonal edges of different sizes of a stack of copy sheets stacked on said stack supporting tray, and wherein a registration edge position is provided for registration of one side of said stack of copy sheets stacked on said stack supporting tray aligned with said upstream direction; the improvement comprising: an upstanding stack rear edge guide track mounted for an elongated range of angular repositioning movement in both said upstream direction and in the direction of said registration edge position to engage a wide range of said different sizes of copy sheets stacked on said stack supporting tray; said angular repositioning movement of said stack rear edge guide engaging larger sheets stacked on said stack supporting tray further from said registration edge position and engaging smaller sheets stacked on said stack supporting tray closer to said registration edge position; and at least one upstanding stack side edge guide repositionable transversely to said registration edge position independently of any position of said stack rear edge guide, said stack side edge guide having a defined elongated repositioning movement range which does not overlap with said elongated range of angular repositioning movement of said stack rear edge guide.

Further specific features disclosed in the embodiment herein, individually or in combination, include those wherein the stack rear edge guide track mounted elongated range of angular repositioning movement is substantially linear and at approximately 18 degrees to said registration edge position; and/or wherein said stack supporting tray has at least first and second separated elongated apertures, and wherein said stack rear edge guide extends upwardly through said first aperture, and wherein said at least one stack side edge guide extends upwardly through said second aperture, and wherein said stack rear edge guide and said at least one stack side edge guide are repositionable independently of said stack supporting tray within said respective first and second apertures; and/or wherein there are two separate, spaced apart, and independently repositionable, said stack side edge guides, an upstream stack side edge guide and a downstream stack edge guide, and said downstream stack edge guide is repositionable substantially closer to said registration edge position than said upstream stack side edge guide.

The term "reproduction apparatus" or "printer" as used herein broadly encompasses various printers, copiers or multifunction machines or systems, xerographic or otherwise. The term "sheet" herein refers to a usually flimsy physical sheet of paper, plastic, or other suitable physical substrate for printing images thereon. A "copy sheet" may be abbreviated as a "copy" or called a "hardcopy".

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, the present invention will be better understood from this description of this specific embodiment, including the drawing figures (which are approximately to scale) wherein:

Figure 1:
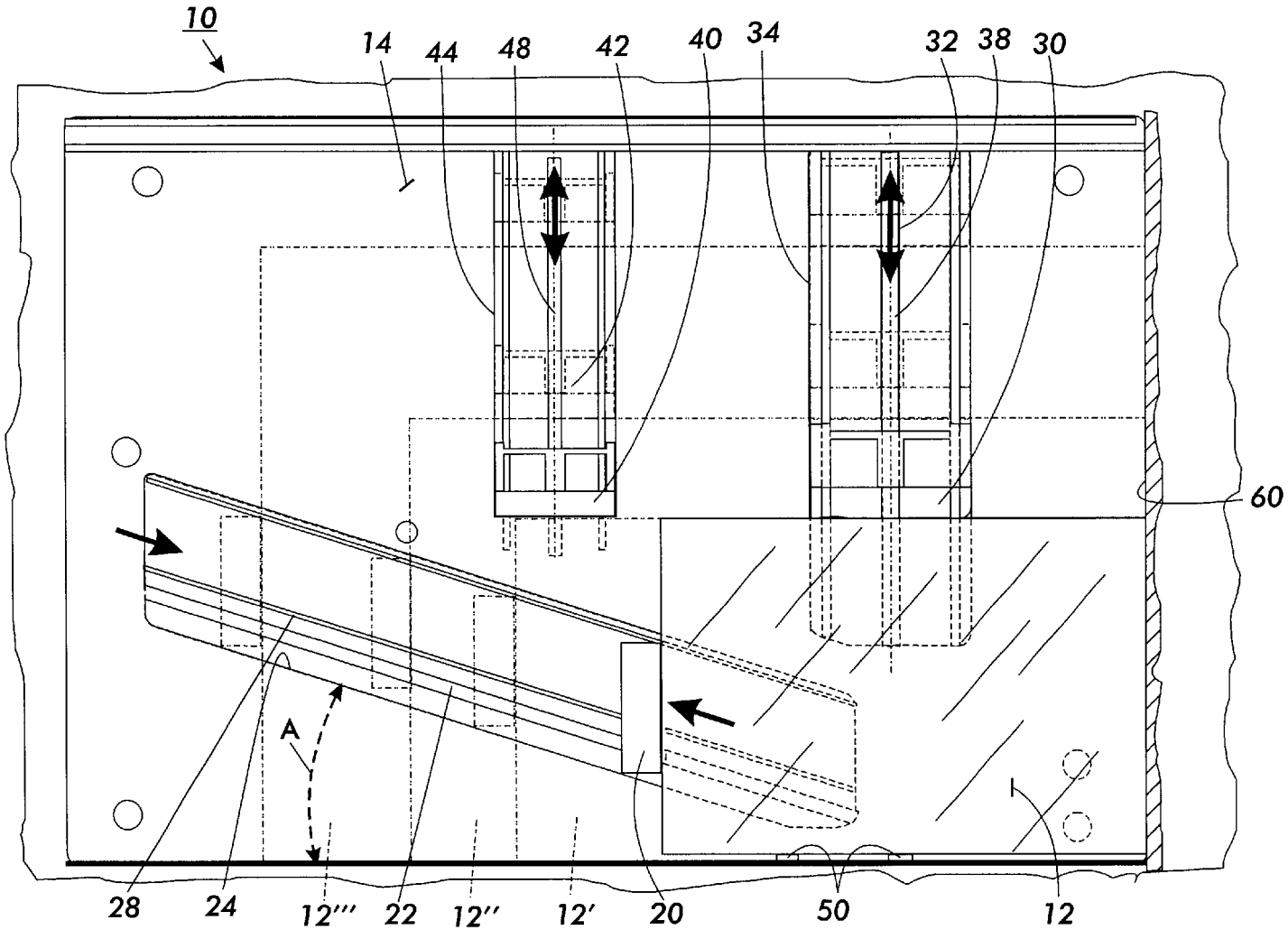
FIG. 1 is a schematic top view of one embodiment of a sheet stacking tray with a stacking guides system for a wide range of sheet sizes in accordance with the present invention, showing in phantom different positions for different standard sheet sizes.

Describing now in further detail the exemplary embodiment with reference to the FIGS., there is shown a sheet stacking tray system 10 for stacking stacks 12 of copy sheets on top of a tray 14. The stack 12 is retained (until fed) in between vertical stacking edge guides, here comprising an adjustable position stack rear edge guide 20, and two independently adjustable position spaced apart stack side edge guides; a lead edge side guide 30 and a trail edge side guide 40, both at the inboard side of the stack 12. The guide position of the other, outboard, side of the stack 12 here is defined by a fixed registration surface 50. A fixed front stacking registration edge guide or wall, at a position 60 (not otherwise illustrated) is also provided, so as to engage the stack 12 on all four sides. That front stacking registration edge guide position 60 may be defined by part of the feeder in operation. The tray 14 may be mounted on a stack elevator system as described above, for vertical movement of the tray 12 to engage the top of the stack 12 with a sheet feeder, not illustrated for drawing clarity, such as shown and described in the above cross-referenced prior applications. Limited tilting movement of the tray 14 may also be provided.

Figure 3:
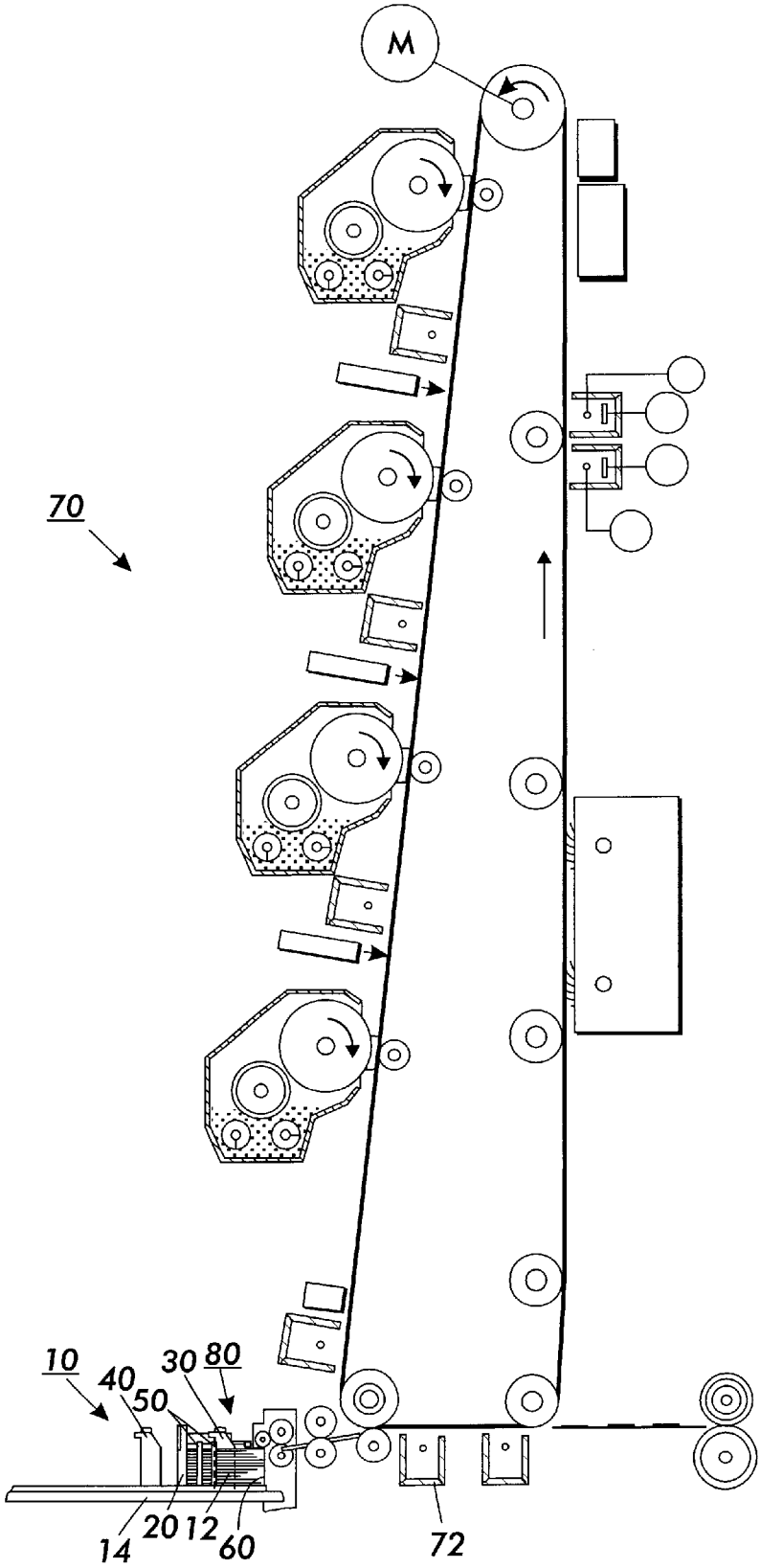
FIG. 3 shows a small schematic side view of the sheet stacking tray with stacking guides of FIGS. 1 and 2 feeding copy sheets to one known example of a xerographic printer (which need not be described).

The entire sheet stacking tray system 10 may be conventionally mounted in a slide-out paper drawer unit of a xerographic printer, such as the printer 70 shown in FIG. 3, or a high-cap paper feeder module therefor, which drawer unit slides out for sheet loading and slides closed for sheet feeding. By having two widely spaced apart stack outboard side edge guides 30 and 40, elongated large sheet stacks 12 may be held in position by both outboard side edge guides 30 and 40 at spaced apart side edge positions, which prevents skewing of sheets on such a stack 12 even if the operator slams the drawer unit closed after loading the stack 12.

Each of these vertically upstanding stack edge guides 20, 30, and 40 is moveably mounted on linear tracks 22, 32 and 42, respectively, and extends up through its own independent elongated slot 24, 34 and 44 in the tray 14, respectively. The stack edge guides are not mounted on the tray 14 and do not move with the tray 14. Their respective track and slot allows each of the stack edge guides 20, 30, and 40 to be freely independently repositioned anywhere along their own track within their own slot, to accommodate widely varying dimensions of the sheets which may stacked into the tray 14. Note that the elongate slots 24, 34 and 44 in the tray 14 do not intersect or overlap, so that all of the movable edge guides can be moved without interference, and also so that the integrity and strength of the tray 14 (which must support the weight of large stacks) is not compromised. There is unapertured tray 14 material between each of the slots 24, 34, 44. Likewise, the corresponding underlying linear tracks 22, 32 and 42 do not overlap or cross one another, yet both accommodate a wide range of paper sizes.

These tracks 22, 32 and 42 for the repositionable edge guides 20, 30 and 40 may be commercially available furniture or filing cabinet tracks or slides, preferably with ball bearings, such has those available from the Waterloo Furniture Company. They may include the simple well known releasable locking mechanisms thereof, in which an aperture in a metal plate lever arm 26, 36, 46 is spring loaded to tilt and grip a metal rod 28, 38, 48 and thus hold the edge guides 20, 30 and 40 in position unless their respective locking lever arm 26, 36, or 46 is manually pressed to allow the edge guide to slide along its track.

It will be noted that the inboard or forward most side edge guide 30 has a longer track 32 and slot 34 so that it can move in much closer to the registration edge 50. This allows this inboard side edge guide 30 to be moved in much further transversely to engage the side of the very smallest sheets, which will normally also be shorter. Here, in the illustrated example, this inboard side edge guide 30 has a large movement range. It can move in to within about 13.5 cm from the registration edge position 50, or move out more than 36 cm away. This greater inward movement for small sheets of the inboard side edge guide 30 is allowed by the angle of the track 22 and slot 24. That is, the forward or downstream portion of the angled track 22 and slot 24 adjacent to and opposite from the inboard side edge guide 30 is much further inward, closer to the registration edge 50, and thus allows for, without interference, a greater inward side edge guide 30 repositioning movement than the outboard side edge guide 40. The outboard side edge guide 40 can have a much shorter track 42 and slot 44 because it does not ever need to move as close to the registration edge 50. That is because the outboard side edge guide 40 is only needed for engaging much longer sheet sizes, which will also be wider, and thus will have their outer side edges further away from the registration edge 50. With the approximately 18 degree angle of the illustrated track 22 and slot 24 for the stack rear edge guide 20, at the outboard or rear end of the track 22 the inside edge of the rear edge guide 20 can be about 14.2 cm from the registration wall 50, while at the inboard or front end of the track 22 the inside edge of the rear edge guide 20 can be only about 3.2 cm from the registration wall 50. That is, the stack rear edge guide 20 automatically shifts laterally towards the registration wall 50 by about 11 cm in this example as it is moved forward down the length of its linear track 22 and linear slot 24.

It will be noted that in this embodiment 10, irrespective of the sheet size, the outboard edge of the stack of sheets 12 is edge registered to the fixed outboard registration edge position 50 aligned with one side of the stacking tray 14. That is, the sheets are edge registered, not center registered, as in some, less common, stacking tray systems, and the outboard edges of the sheets are stacked approximately in line with the outboard edge of the tray 14, for any size sheets. Likewise, the sheet lead edges of any size sheet stack being loaded into the tray 14 are aligned with the front registration edge position 60. Then, the rear or trail edge guide 20 is pushed up against the trail edge of all the sheets in the loaded stack 12 by moving along its angled guide path track 22 The two inboard edge guides 30 and 40 are repositioned along their transverse guide path tracks 32 and 42 until they engage the inboard side of that particular loaded stack of sheets 12. If the stack of sheets 12 is of a small enough sheet size, or medium size sheets which have been loaded for feeding long edge first (widthwise), such as U.S. or European letter or legal size sheets, then only the first or inboard edge guide 30 will engage that stack 12. However, those short sheet stacks are not subject to the above-described stack skewing problem and do not need engagement by the second, outboard, edge guide 40.

Referring to the top view of FIG. 1, there is illustrated in solid lines a stack 12 of U.S. letter size sheets loaded in the tray 14 short edge first (for lengthwise feeding) engaged by the rear or edge guide 20 and inboard lead edge guide 30 shown in solid lines. The FIG. 1 illustrated next larger sheet stack 12' (shown in phantom lines) is of the same 8.5" (21.6 cm) width but 14.33" (36.4 cm) long. The next larger sheet size stack 12" (shown in phantom lines) is 11"×17" (27.9×43.2 cm). The largest size sheet stack 12'" shown in phantom lines here in FIG. 1 is 14.33"×20.5" (36.4×52.1 cm). The corresponding stack engagement positions of the edge guides 20, 30 and 40 for those three exemplary larger sheet sizes are also shown here in phantom. It will be seen that for all of these illustrated different sheet sizes (in their illustrated stacking orientations) that the repositioned rear edge guide 20 is desirably engaged with center of the rear edge of the stack. Of course there will be some other sheet sizes and stacking orientations for which the rear edge guide 20 will not fully or evenly centrally engage the rear edge of the stack, such as letter or legal size sheets stacked widthwise or long edge first.

However, for almost all sizes of sheets to be loaded and fed, the angular repositioning movement of the rear edge guide 20 will cause that rear edge guide to engage the rear edge of the stack more centrally than if it were (normally) mounted for movement parallel to the sheet feeding direction, and without hitting or interfering with any movement of the side guides 30 or 40. Thus, as noted above, the disclosed sheet stacking tray system embodiment 10 is particularly suited for improved stacking, locating, guiding and feeding of a uniquely wide range of different sizes of copy sheets.

The stack rear edge (trail edge) guide 20 is repositionable along a predetermined angled path defined by its track 22 at a small preset angle to the sheet feeding direction and to the registration wall or edge position 50. Here in this example that angle "A" is 17.5 degrees, but the concept is not limited to that specific angle, which could be varied by 5 or more degrees therefrom, depending on the tray design and the desired maximum and minimum sheet size capability. As the stack rear edge guide 20 is repositioned forwardly (downstream) to engage shorter size sheets stacked therein, it also automatically also moves laterally towards the registration side 50. With this forward angular repositioning movement of the stack rear edge guide 20, it automatically moves closer to that stack edge registration side of the stacking tray 14. Conversely, when the stack rear edge guide 20 is moved rearwardly to accommodate the stacking of larger sheets it automatically moves laterally away from the registration side 50 toward the center of the tray 14 and hence towards the center of the larger stacks rear edge. The initial lateral positions, and said variable positions along said angled path, of this rear edge guide 20 are selected so that for many standard sheet sizes said rear edge guide will more centrally engage the rear edge of the stack for both larger and smaller size copy sheets stacked in the same sheet stacking tray 14.

Furthermore, and cooperatively, all of the angular movement positions of the rear edge guide 20 are designed to avoid any interference or overlapping with the guide tracks or movement ranges of the transversely movable (repositionable) side guides 30 and 40 engaging the opposite side of the stack from the stack edge registration side 50.

With this system, various standard sheets sizes over a wide range, from, e.g., approximately 5.5"×7" (14×17.8 cm.) to 14.33"×20.5" (36.4×52 cm.) can be desirably held and fed with the rear edge guide 20 centrally positioned at the nominal midpoint of the sheet stack 12 rear or trail edge for many of those very different sheet sizes, as shown in the above-described examples of FIG. 1.

Figure 2:
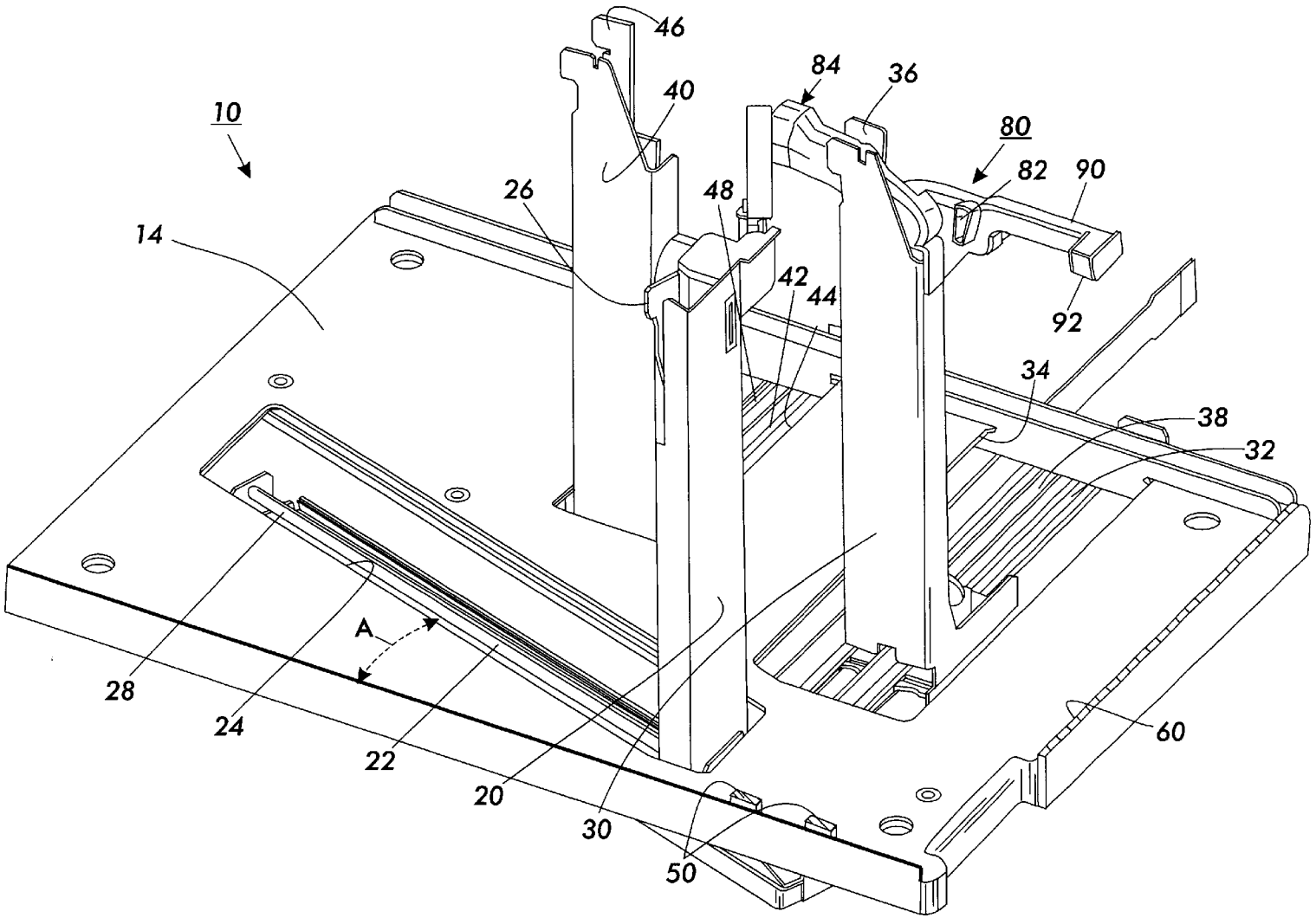
FIG. 2 is a more detailed perspective view of the exemplary system of the sheet stacking tray with stacking guides of FIG. 1.

Turning now to some other optional additional details disclosed in FIG. 2 and the above cross-referenced patent applications, sheet air fluffers 80 with air nozzles 82 such as the one illustrated near the top of the side guide 30 in FIG. 2 may be provided for partially separating or levitating the uppermost sheets of the stack of sheets 12 in this exemplary stacking tray 14. They may each be connected 84 with flexible air hoses to a low pressure air supply in the printer 70 to provide improved sheet separation and feeding assistance. By such air injector nozzles 82 being on the (repositioned) edge guides near the tops thereof, the air nozzles 82 will be closely adjacent to the top of the stack edges. Multiple such air jets of this or different configurations may be so provided impinging on all four sides of the stack of paper to improve performance. To help prevent skewing of free floating top sheets, extensions such as 90 in FIG. 2 may also be provided on the inboard side guide 30. As shown, the extension 90 may be integral with the air fluffers 80, and have a downwardly sloping (angled) stack edge engagement surface member 92, which may be spring loaded against the top sheets of the stack. However, none of this is relevant to the subject system, which can also be used in stacking trays for feeding sheets without any such air fluffing systems.

It will be appreciated by those skilled in the art that downstream sheet deskew and registration systems will normally be provided between a sheet stacking tray such as 14 and its sheet feeder and the subsequent feeding of those sheets to an image transfer station such as 72 of a printer such as in the printer example 70 of FIG. 3. An example of one suitable such sheet deskew and registration system is described in detail in copending and commonly assigned U.S. application Ser. Nos. 09/312,675 and 09/312,999, filed May 17, 1999, now U.S. Pat. Nos. 6,173,952 and 6,168,153.

Examples of some standard copy sheet sizes are shown in the table below.

Common Standard Commercial Paper Sheet Sizes

| Size Description | Size in Inches | Size in Centimeters |
|---|---|---|
| 1. U.S. Government (old) | 8 × 10.5 | 20.3 × 26.7 |
| 2. U.S. Letter | 8.5 × 11 | 21.6 × 27.9 |
| 3. U.S. Legal | 8.5 × 13 | 21.6 × 33.0 |
| 4. U.S. Legal | 8.5 × 14 | 21.6 × 35.6 |
| 5. U.S. Engineering | 9 × 12 | 22.9 × 30.5 |
| 6. ISO* B5 | 6.93 × 9.84 | 17.6 × 25.0 |
| 7. ISO* A4 | 8.27 × 11.69 | 21.0 × 29.7 |
| 8. ISO* B4 | 9.84 × 13.9 | 25.0 × 35.3 |
| 9. Japanese B5 | 7.17 × 10.12 | 18.2 × 25.7 |
| 10. Japanese B4 | 10.12 × 14.33 | 25.7 × 36.4 |

*International Standards Organization

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a sheet stacking tray system for stacking different sizes of copy sheets to be fed upstream to a reproduction apparatus for the printing of said copy sheets, said stacking tray system having a stack supporting tray and plural upstanding stack edge guides for engaging at least two sides of a stack of copy sheets on said stack supporting tray, and wherein said plural stack edge guides are repositionable relative to said stack supporting tray for engaging at least two orthogonal edges of different sizes of a stack of copy sheets stacked on said stack supporting tray, and wherein a registration edge position is provided for registration of one side of said stack of copy sheets stacked on said stack supporting tray aligned with said upstream direction; wherein one said upstanding stack edge guide comprises;

a track-mounted upstanding stack rear edge guide which is track-mounted for an elongated range of angular repositioning movement in both said upstream direction and in the direction of said registration edge position to engage a wide range of said different sizes of copy sheets stacked on said stack supporting tray;

said elongated range of angular repositioning movement of said track-mounted upstanding stack rear edge guide engaging larger sheets stacked on said stack supporting tray further from said registration edge position and engaging smaller sheets stacked on said stack supporting tray closer to said registration edge position; and at least one other said upstanding stack edge guide comprising an upstanding stack side edge guide which is repositionable transversely to said registration edge position independently of any position of said upstanding stack rear edge guide, said upstanding stack side edge guide having a defined elongated repositioning movement range transversely to said registration edge which does not overlap with said elongated range of angular repositioning movement of said track-mounted upstanding stack rear edge guide.

2. The sheet stacking tray system of claim 1, wherein said track-mounted upstanding stack rear edge guide elongated range of angular repositioning movement is substantially linear and at approximately 18 degrees to said registration edge position.

3. The sheet stacking tray system of claim 1, wherein said stack supporting tray has at least first and second separated elongated apertures, and wherein said stack rear edge guide extends upwardly through said first aperture, and wherein said at least one stack side edge guide extends upwardly through said second aperture, and wherein said stack rear edge guide and said at least one stack side edge guide are repositionable independently of said stack supporting tray within said respective first and second apertures.

4. In a sheet stacking tray system for stacking different sizes of copy sheets to be fed upstream to a reproduction apparatus for the printing of said copy sheets, said stacking tray system having a stack supporting tray and plural upstanding stack edge guides for engaging at least two sides of a stack of copy sheets on said stack supporting tray, and wherein said plural stack edge guides are repositionable relative to said stack supporting tray for engaging at least two orthogonal edges of different sizes of a stack of copy sheets stacked on said stack supporting tray, and wherein a registration edge position is provided for registration of one side of said stack of copy sheets stacked on said stack supporting tray aligned with said upstream direction; wherein one said upstanding stack edge guide comprises;

a track-mounted upstanding stack rear edge guide which is track-mounted for an elongated range of angular repositioning movement in both said upstream direction and in the direction of said registration edge position to engage a wide range of said different sizes of copy sheets stacked on said stack supporting tray;

said elongated range of angular repositioning movement of said track-mounted upstanding stack rear edge guide engaging larger sheets stacked on said stack supporting tray further from said registration edge position and engaging smaller sheets stacked on said stack supporting tray closer to said registration edge position; and at least one other said upstanding stack edge guide comprising an upstanding stack side edge guide which is repositionable transversely to said registration edge position independently of any position of said upstanding stack rear edge guide, said upstanding stack side edge guide having a defined elongated repositioning movement range transversely to said registration edge which does not overlap with said elongated range of angular repositioning movement of said track-mounted upstanding stack rear edge guide, wherein there are two separate, spaced apart, and independently repositionable, said stack side edge guides, an upstream stack side edge guide and a downstream stack edge guide, and said downstream stack edge guide is repositionable substantially closer to said registration edge position than said upstream stack side edge guide.

* * * * *